US006919698B2

(12) United States Patent
Krichtafovitch

(10) Patent No.: US 6,919,698 B2
(45) Date of Patent: Jul. 19, 2005

(54) ELECTROSTATIC FLUID ACCELERATOR FOR AND METHOD OF CONTROLLING A FLUID FLOW

(75) Inventor: Igor A. Krichtafovitch, Kirkland, WA (US)

(73) Assignee: Kronos Advanced Technologies, Inc., Belmont, MA (US)

( * ) Notice: Subject to any disclaimer, the term of this patent is extended or adjusted under 35 U.S.C. 154(b) by 0 days.

(21) Appl. No.: 10/352,193

(22) Filed: Jan. 28, 2003

(65) Prior Publication Data

US 2004/0155612 A1 Aug. 12, 2004

(51) Int. Cl.[7] ..... H05H 7/00
(52) U.S. Cl. ..... 315/506; 204/176
(58) Field of Search ..... 315/111.01, 111.91, 315/500, 506; 204/176; 422/186.07; 361/230, 232, 226

(56) References Cited

U.S. PATENT DOCUMENTS

| | | | | |
|---|---|---|---|---|
| 2,765,975 A | | 10/1956 | Lindenblad | 315/111.91 |
| 3,026,964 A | | 3/1962 | Penney | 96/74 |
| 3,071,705 A | | 1/1963 | Coleman et al. | 60/202 |
| 3,198,726 A | | 8/1965 | Trikilis | 422/186.18 |
| 3,740,927 A | | 6/1973 | Vincent | 96/54 |
| 3,907,520 A | | 9/1975 | Huang et al. | 95/62 |
| 3,918,939 A | | 11/1975 | Hardt | 96/99 |
| 3,981,695 A | | 9/1976 | Fuchs | 96/77 |
| 3,984,215 A | | 10/1976 | Zucker | 95/81 |
| 4,086,152 A | * | 4/1978 | Rich et al. | 204/176 |
| 4,210,847 A | | 7/1980 | Shannon et al. | |
| 4,216,000 A | | 8/1980 | Kofoid | 96/80 |
| 4,231,766 A | | 11/1980 | Spurgin | |
| RE30,480 E | | 1/1981 | Gelfand | 55/136 |
| 4,315,837 A | | 2/1982 | Rourke et al. | 502/402 |
| 4,376,637 A | | 3/1983 | Yang | 95/74 |
| 4,401,385 A | | 8/1983 | Katayama et al. | 399/93 |
| 4,481,017 A | | 11/1984 | Furlong | 95/74 |
| 4,600,411 A | | 7/1986 | Santamaria | 96/82 |
| 4,604,112 A | | 8/1986 | Ciliberti et al. | 96/43 |
| 4,646,196 A | | 2/1987 | Reale | 361/230 |
| 4,649,703 A | | 3/1987 | Dettling et al. | 60/275 |
| 4,740,826 A | | 4/1988 | Halleck | 257/334 |
| 4,741,746 A | | 5/1988 | Chao et al. | 96/43 |
| 4,775,915 A | | 10/1988 | Walgrove, III | 361/225 |
| 4,783,595 A | | 11/1988 | Seidl | 250/423 R |
| 4,789,801 A | | 12/1988 | Lee | |
| 4,790,861 A | | 12/1988 | Watai et al. | 96/97 |
| 4,812,711 A | | 3/1989 | Torok et al. | |
| 4,838,021 A | | 6/1989 | Beattie | 60/202 |
| 4,878,149 A | | 10/1989 | Stiehl et al. | 361/230 |

(Continued)

OTHER PUBLICATIONS

Request for Ex Parte Reexamination under 37 C.F.R. 1.510; application No. 90/007,276, filed on Oct. 29, 2004.

*Primary Examiner*—Wilson Lee
(74) *Attorney, Agent, or Firm*—Fulbright & Jaworski LLP

(57) ABSTRACT

An electrostatic fluid accelerator includes a first number of corona electrodes and a second number of accelerating electrodes spaced apart from and parallel to adjacent ones of the corona electrodes. An electrical power source is connected to supply the corona and accelerating electrodes with an operating voltage to produce a high intensity electric field in an inter-electrode space between the corona electrodes and the accelerating electrodes. The accelerating electrodes may be made of a high electrical resistivity material, each of the electrodes having mutually perpendicular length and height dimension oriented transverse to a desired fluid flow direction and a width dimension oriented parallel to the desired fluid flow direction. A length of the electrodes in a direction transverse to a desired fluid flow direction is greater than a width of the electrodes parallel to the fluid flow direction, and the width of the electrodes is at least ten times a height of the electrodes in a direction transverse to both the desired fluid flow direction and to the length.

86 Claims, 6 Drawing Sheets

U.S. PATENT DOCUMENTS

| | | | | |
|---|---|---|---|---|
| 4,938,786 | A | 7/1990 | Tonomoto | 96/17 |
| 5,059,219 | A | 10/1991 | Plaks et al. | 96/77 |
| 5,077,500 | A | 12/1991 | Torok et al. | |
| 5,087,943 | A | 2/1992 | Creveling | 399/93 |
| 5,136,461 | A | 8/1992 | Zellweger | 361/231 |
| 5,138,513 | A | 8/1992 | Weinstein | 361/2 |
| 5,163,983 | A | 11/1992 | Lee | 96/22 |
| 5,199,257 | A | 4/1993 | Colletta et al. | 96/76 |
| 5,257,073 | A | 10/1993 | Gross et al. | 399/171 |
| 5,269,131 | A | 12/1993 | Brophy | 60/202 |
| 5,369,953 | A | 12/1994 | Brophy | 60/202 |
| 5,423,902 | A | 6/1995 | Strutz et al. | 95/273 |
| 5,508,880 | A | 4/1996 | Beyer | 361/230 |
| 5,667,564 | A | 9/1997 | Weinberg | |
| 5,847,917 | A | 12/1998 | Suzuki | 361/213 |
| D411,001 | S | 6/1999 | Pinchuk | D23/364 |
| 5,920,474 | A | 6/1999 | Johnson et al. | 363/126 |
| D420,438 | S | 2/2000 | Pinchuk | D23/364 |
| D427,300 | S | 6/2000 | Pinchuk | D23/364 |
| 6,108,504 | A | 8/2000 | Dickhoff | 399/170 |
| D433,494 | S | 11/2000 | Pinchuk et al. | D23/364 |
| D434,483 | S | 11/2000 | Pinchuk | D23/364 |
| 6,176,977 | B1 | 1/2001 | Taylor et al. | |
| D438,513 | S | 3/2001 | Pinchuk | D13/168 |
| 6,195,827 | B1 | 3/2001 | Dumitriu | 15/1.51 |
| D440,290 | S | 4/2001 | Pinchuk | D23/355 |
| 6,228,330 | B1 | 5/2001 | Herrmann et al. | 422/186.05 |
| 6,394,086 | B1 | 5/2002 | Barnes et al. | 128/203.15 |
| 6,574,123 | B2 | 6/2003 | Wiser et al. | 363/50 |
| 2002/0122751 | A1 | 9/2002 | Sinaiko et al. | 422/186 |
| 2002/0122752 | A1 | 9/2002 | Taylor et al. | 422/186 |
| 2002/0127156 | A1 | 9/2002 | Taylor | 422/186 |
| 2002/0155041 | A1 | 10/2002 | McKinney, Jr. et al. | 422/186.04 |
| 2003/0033176 | A1 | 2/2003 | Hancock | 705/6 |
| 2003/0147785 | A1 | 7/2003 | Joannou | 422/186.04 |
| 2003/0165410 | A1 | 9/2003 | Taylor | 422/186.04 |
| 2003/0170150 | A1 | 9/2003 | Lau et al. | 422/186 |
| 2003/0206837 | A1 | 11/2003 | Taylor et al. | 422/186 |
| 2003/0206839 | A1 | 11/2003 | Taylor et al. | 422/186.04 |
| 2003/0206840 | A1 | 11/2003 | Taylor et al. | 422/186.04 |
| 2003/0209420 | A1 | 11/2003 | Taylor et al. | 204/164 |
| 2004/0025497 | A1 | 2/2004 | Truce | 60/275 |
| 2004/0033340 | A1 | 2/2004 | Lau et al. | 428/137 |
| 2004/0047775 | A1 | 3/2004 | Lau et al. | 422/186.04 |
| 2004/0052700 | A1 | 3/2004 | Kotlyar et al. | 422/186.04 |
| 2004/0057882 | A1 | 3/2004 | Lau et al. | 422/186.04 |
| 2004/0079233 | A1 | 4/2004 | Lau et al. | 96/51 |

* cited by examiner

ELECTROSTATIC FLUID ACCELERATOR FOR AND METHOD OF CONTROLLING A FLUID FLOW

BACKGROUND OF THE INVENTION

1. Field of the Invention

The invention relates to a device for accelerating, and thereby imparting velocity and momentum to a fluid, and particularly to the use of corona discharge technology to generate ions and electrical fields especially through the use of ions and electrical fields for the movement and control of fluids such as air, other fluids, etc.

2. Description of the Related Art

A number of patents (see, e.g., U.S. Pat. No. 4,210,847 by Shannon, et al. and U.S. Pat. No. 4,231,766 by Spurgin) describe ion generation using an electrode (termed the "corona electrode"), accelerating and, thereby, accelerating the ions toward another electrode (termed the "accelerating", "collecting" or "target" electrode), thereby imparting momentum to the ions in a direction toward the accelerating electrode. Collisions between the ions and an intervening fluid, such as surrounding air molecules, transfer the momentum of the ions to the fluid inducing a corresponding movement of the fluid to achieve an overall movement in a desired fluid flow direction.

U.S. Pat. No. 4,789,801 of Lee, U.S. Pat. No. 5,667,564 of Weinberg, U.S. Pat. No. 6,176,977 of Taylor, et al., and U.S. Pat. No. 4,643,745 of Sakakibara, et al. also describe air movement devices that accelerate air using an electrostatic field. Air velocity achieved in these devices is very low and is not practical for commercial or industrial applications.

U.S. Pat. Nos. 4,812,711 and 5,077,500 of Torok et al. describe the use of Electrostatic Air Accelerators (EFA) having a combination of different electrodes placed at various locations with respect to each other and different voltage potentials. These EFAs use a conductive or high resistance electrode material to conduct an electrical corona current.

Unfortunately, none of these devices is able to produce a commercially viable amount of the airflow. Varying relative location of the electrodes with respect to each other provides only a limited improvement in EFA performance and fluid velocity. For example, U.S. Pat. No. 4,812,711 reports generating an air velocity of only 0.5 m/s, far below that expected of and available from commercial fans and blowers.

Accordingly, a need exists for a practical electrostatic fluid accelerator capable of producing commercially useful flow rates.

SUMMARY OF THE INVENTION

The invention addresses several deficiencies in the prior art limitations on airflow and the general inability to attain theoretical optimal performance. One of these deficiencies includes a limited ability to produce a substantial fluid flow suitable for commercial use. Another deficiency is a necessity for large electrode structures (other than the corona electrodes) to avoid generating a high intensity electric field. Using physically large electrodes further increases fluid flow resistance and limits EFA capacity and efficiency.

Still other problem arises when an EFA operates near or at maximum capacity, i.e., with some maximum voltage applied and power consumed. In this case, the operational voltage applied is characteristically maintained near a dielectric breakdown voltage such that undesirable electrical events may result such as sparking and/or arcing. Still a further disadvantage may result if unintended contact is made with one of the electrodes, potentially producing a substantial current flow through a person that is both unpleasant and often dangerous.

Still another problem arises using thin wires typically employed as corona electrodes. Such wires must be relatively thin (usually about 0.004" in diameter) and are fragile and therefore difficult to clean or otherwise handle.

Still another problem arises when a more powerful fluid flow is necessary or desirable (e.g., higher fluid flow rates). Conventional multiple stage arrangements result in a relatively low electrode density (and, therefore, insufficient maximum achievable power) since the corona electrodes must be located at a minimum distance from each other in order to avoid mutual interference to their respective electrical fields. The spacing requirement increases volume and limits electrode density.

An embodiment of the present invention provides an innovative solution to increase fluid flow by using an innovative electrode geometry and optimized mutual electrode location (i.e., inter-electrode geometry) by the use of a high resistance material in the construction and fabrication of accelerating electrodes.

According to an embodiment of the invention, a plurality of corona electrodes and accelerating electrodes are positioned parallel to each other, some of the electrodes extending between respective planes perpendicular to an airflow direction. The corona electrodes are made of an electrically conductive material, such as metal or a conductive ceramic. The corona electrodes may be in the shape of thin wires, blades or strips. It should be noted that a corona discharge takes place at the narrow area of the corona electrode, these narrow areas termed here as "ionizing edges". These edges are generally located at the downstream side of the corona electrodes with respect to a desired fluid flow direction. Other electrodes (e.g., accelerating electrodes) are in the shape of bars or thin strips that extend in a primary direction of fluid flow. Generally the number of the corona electrodes is equal to the number of the accelerating electrodes ±1. That is, each corona electrode is located opposite and parallel to one or two adjacent accelerating electrodes.

Accelerating electrodes are made of high resistance material that provides a high resistance path, i.e., are made of a high resistivity material that readily conducts a corona current without incurring a significant voltage drop across the electrode. For example, the accelerating electrodes are made of a relatively high resistance material, such as carbon filled plastic, silicon, gallium arsenide, indium phosphide, boron nitride, silicon carbide, cadmium selenide, etc. These materials should typically have a specific resistivity ρ in the range of $10^3$ to $10^9$ 'Ω-cm and, more preferably, between $10^5$ to $10^8$ 'Ω-cm with a more preferred range between $10^6$ and $10^7$ 'Ω-cm.)

At the same time, a geometry of the electrodes is selected so that a local event or disturbance, such as sparking or arcing, may be terminated without significant current increase or sound being generated.

The present invention increases EFA electrode density (typically measured in 'electrode length'-per-volume) and significantly decreases aerodynamic fluid resistance caused by the electrode as related to the physical thickness of the electrode. An additional advantage of the present invention is that it provides virtually spark-free operation irrespective of how near an operational voltage applied to the electrodes approaches an electrical dielectric breakdown limit. Still an additional advantage of the present invention is the provision of a more robust corona electrode shape making the electrode more sturdy and reliable. The design of the electrode makes it possible to make a "trouble-free" EFA, e.g., one that will not present a safety hazard if unintentionally touched.

Still another advantage of an embodiment of the present invention is the use of electrodes using other than solid materials for providing a corona discharge. For example, a conductive fluid may be efficiently employed for the corona discharge emission, supporting greater power handling capabilities and, therefore, increased fluid velocity. In addition fluid may alter electrochemical processes in the vicinity of the corona discharge sheath and generate, for example, less ozone (in case of air) than might be generated by a solid corona material or provide chemical alteration of passing fluid (for instantaneous, harmful gases destruction).

DESCRIPTION OF THE PREFERRED EMBODIMENT

Figure 1:
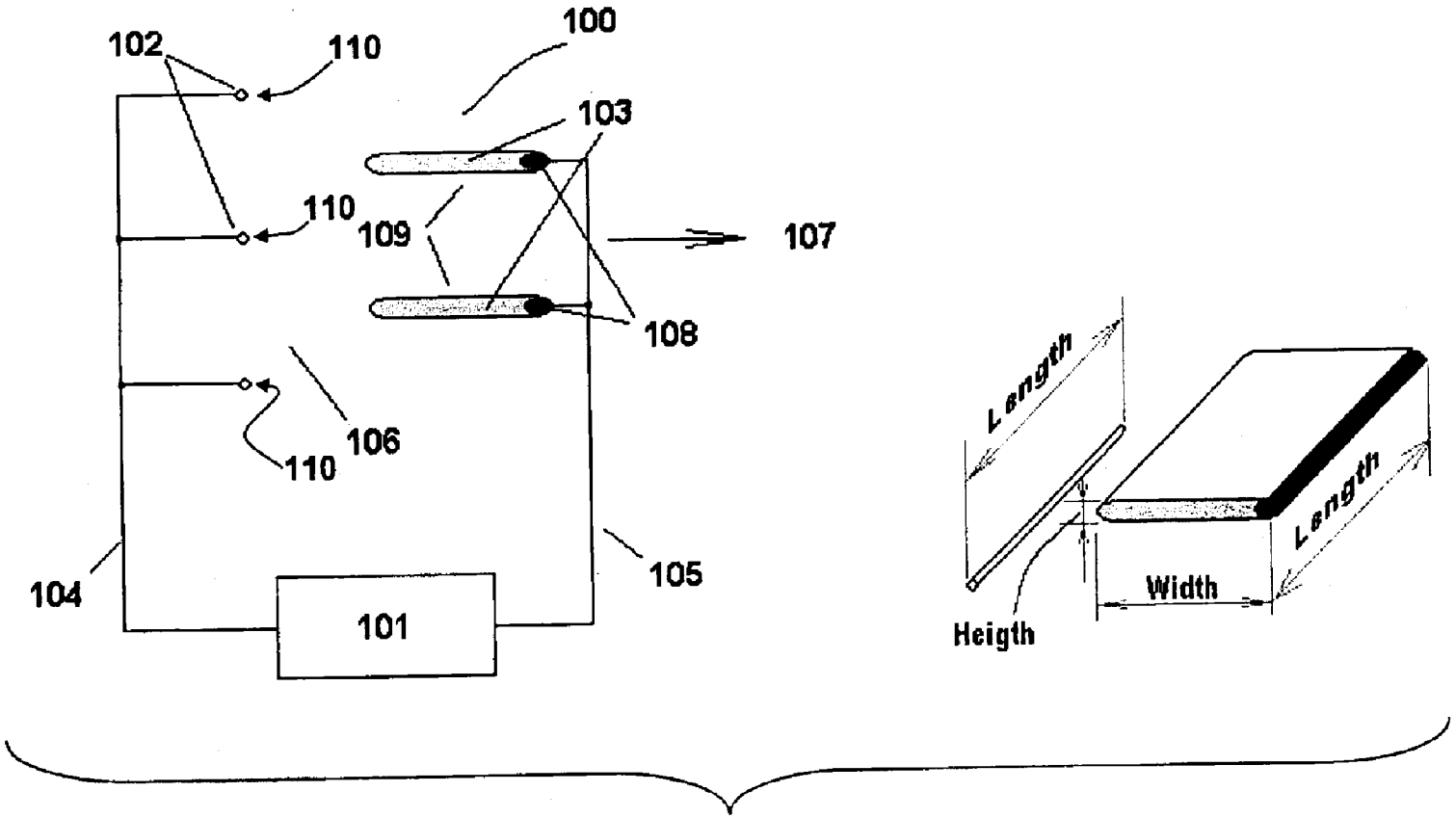
FIG. 1 is a schematic diagram of EFA assembly with corona electrodes formed as thin wires that are spaced apart from electrically opposing high resistance accelerating electrodes.

FIG. 1 is a schematic diagram of EFA device 100 including wire-like corona electrodes 102 (three are shown for purposes of the present example although other numbers may be included, a typical device having ten or hundreds of electrodes in appropriate arrays to provide a desired performance) and accelerating electrodes 109 (two in the present simplified example). Each of the accelerating electrodes 109 includes a relatively high resistance portion 103 and a low resistance portion 108. High resistance portion portions 103 have a specific resistivity ρ within a range of $10^{1}$ to $10^{9}$ 'Ω-cm and, more preferably, between $10^{5}$ and $10^{8}$ 'Ω-cm with a more preferred range between $10^{6}$ and $10^{7}$ 'Ω-cm.

All the electrodes are shown in cross section. Thus corona electrodes 102 are in the form or shape of thin wires, while accelerating electrodes 109 are in the shape of bars or plates. "Downstream" portions of corona electrodes 102 closest to accelerating electrodes 109 form ionizing edges 110. Corona electrodes 102 as well as low resistance portion 108 of accelerating electrodes 109 are connected to opposite polarity terminals of high voltage power supply (HVPS) 101 via wire conductors 104 and 105. Low resistance portion 108 has a specific resistivity $\rho \leqq 10^{4}$ 'Ω-cm and preferably, no greater than 1 'Ω-cm and, even more preferably, no greater than 0.1 'Ω-cm. EFA 100 produces a fluid flow in a desired fluid flow direction shown by the arrow 107.

HVPS 101 is configured to generate a predetermined voltage between electrodes 102 and collecting electrodes 109 such that an electric field is formed in between the electrodes. This electric field is represented by the dotted flux lines schematically shown as 106. When the voltage exceeds a so-called "corona onset voltage," a corona discharge activity is initiated in the vicinity of corona electrodes 102, resulting in a corresponding ion emission process from corona electrodes 102.

The corona discharge process causes fluid ions to be emitted from corona electrodes 102 and accelerated toward accelerating electrodes 109 along and following the electric field lines 106. The corona current, in the form of free ions and other charged particulates, approaches the closest ends of accelerating electrodes 109. The corona current then flows along the path of lowest electrical resistance through the electrodes as opposed to some high resistance path of the surrounding fluid. Since high resistance portion 103 of accelerating electrodes 109 has a lower resistance that the surrounding ionized fluid, a significant portion of the corona current flows through the body of the accelerating electrodes 109, i.e., through high resistance portion 103 to low resistance portion 108, the return path to HVPS 101 completed via connecting wire 105. As the electric current flows along the width (see FIG. 1) of high resistance portion 103 (parallel to the main direction of airflow 107 a voltage drop Vd is produced along the current path). This voltage drop is proportional to the corona current Ic times a resistance R of high resistance portion 103 (ignoring, for the moment, resistance of low resistance portion 108 and connecting wires). Then actual voltage applied Va between corona wires 102 and the respective closest ends of the accelerating electrodes 109 is less than output voltage Vout of the HVPS 101 due to the resistance induced voltage drop, i.e., $$V_a = V_{out} - V_d = V_{out} - I_c * R \quad (1).$$

Note that the corona current is non-linearly proportional to the voltage $V_a$ between corona electrodes 102 and the ends of accelerating electrodes 109, i.e., current increases more rapidly than does voltage. The voltage-current relationship may be approximated by the empirical expression:

$$I_c = k_1 * (V_a - V_o)^{1.5}, \quad (2)$$

where $V_o$=corona onset voltage and $k_1$=is an empirically determined coefficient. This non-linear relation provides a desirable feedback that, in effect, automatically controls the value of the resultant voltage appearing across the electrodes, $V_a$, and prevents, minimizes, mitigates or alleviates disturbances and irregularities of the corona discharge. Note that the corona discharge process is considered "irregular" by nature (i.e., "unpredictable"), the corona current value depending on multiple environmental factors subject to change, such as temperature, contamination, moisture, foreign objects, etc. If for some reason the corona current becomes greater at one location of an inter-electrode space than at some other location, a voltage drop $V_d$ along the corresponding high resistance portion 103 will be greater and therefore actual voltage $V_a$ at this location will be lower. This, in turn, limits the corona current at this location and prevents or minimizes sparking or arcing onset.

The following example is presented for illustrative purposes using typical component values as might be used in one embodiment of the invention. In one of the embodiment of EFA 100, as schematically shown in the FIG. 1, a corona onset voltage is assumed to be equal to 8.6 kV to achieve a minimum electric field strength of 30 kV/cm in the vicinity of the corona electrodes 102. This value may be determined by calculation, measurement, or otherwise and is typical of a corona onset value for a corona/accelerating electrode spacing of 10 mm and a corona electrode diameter of 0.1 mm. The total resistance $R_{total}$ of high resistance portion 103 for of accelerating electrodes 109 is equal to 0.5 M 'Ω while the width of high resistance portion 103 along airflow direction 107 (see FIG. 1) is equal to 1 inch. The length of accelerating electrodes 109 transverse to the direction of airflow (i.e., into the drawing plane) is equal to 24 inches. Therefore, for each inch of accelerating electrodes 109 has a resistivity $R_{inch}$ $$R_{inch}=R_{total}*24=12\text{ M'}\Omega$$

Empirical coefficient $k_1$ for this particular design is equal to $22*10^{-6}$. At an applied voltage $V_a$ equal to 12.5 kV the corona current $I_c$ is equal to $$I_c=4.6\times10^{-9}*(12{,}500V-8{,}600V)^{1.5}=1.12\text{ mA.}$$

The corona current $I_{c/inch}$ flowing through each inch of the semiconductor portion 103 however is equal to $$1.12\text{ mA}/24\text{ inches}=47\ \mu\text{A/inch.}$$

Thus, the voltage drop $V_d$ across this one-inch length of semiconductor portion 103 is equal to $$V_d=47*10^{-6}A*12*10^{6}\ '\Omega=564V.$$

$V_{out}$ from HVPS 101 is equal to the sum of voltage $V_a$ applied to the electrodes and the voltage drop $V_d$ across semiconductor portion 103 of accelerating electrode 109 as follows:

$$V_{out}=12{,}500+564=13{,}064\ V.$$

If, for some reason, the corona current at some local area increases to, for example, twice the fully distributed value of 47 μA/inch so that it is equal to 94 μA at some point, the resultant voltage drop $V_d$ will reflect this change and be equal to 1,128 V (i.e., $Vd=94\times10^{-6}\ \mu A*12\times10^{6}\ '\Omega$). Then $V_a=V_{out}-V_d=13{,}064-1{,}128=11{,}936V$. Thus the increased voltage drop $V_d$ dampens the actual voltage level at the local area and limits the corona current at this area. According to formula (2) the corona current $I_c$ through this one inch length may be expressed as $4.6*10^{-9}$ $(11{,}936\ -8{,}600V)^{1.5}/24$ inches=0.886 mA as opposed to 1.12 mA. This "negative feedback" effect thereby operates to restore normal EFA operation even in the event of some local irregularities. In an extreme situation of a short circuit caused by, for example, a foreign object coming within the inter-electrode space (e.g., dust, etc.), the maximum current through the circuit is effectively limited by the resistance of the local area at which the foreign object contacts the electrodes.

Let us consider a foreign object like a finger or screwdriver shorting together two electrodes, i.e., providing a relatively low resistance (in comparison to the electrical resistance of the intervening fluid) electrical path between corona electrode 102 and accelerating electrode 109. It may be reasonably assumed that current will flow through an area having a width that is approximately equal to the width of high resistivity portion 103, i.e., 1 inch. Therefore, the foreign object may cause a maximum current flow $I_{max}$ equal to $$I_{max}=V_{out}/R_{total}=13{,}064V/12*10^{6'}\Omega=1.2\text{ mA}$$

that is just slightly greater than the nominal operational current 1.12 mA. Such a small increase in current should not cause any electrical shock danger or generate any unpleasant sounds (e.g., arcing and popping noises). At the same time maximum operational current of the entire EFA is limited to:

$$I_{max}=13{,}064V/0.5M\ '\Omega=26\text{ mA}$$

a value sufficient to produce a powerful fluid flow, e.g., at least 100 $ft^3$/min. Should the accelerating electrodes be made of metal or another material with a relatively low resistivity (e.g., $\rho\leqq10^{4'}$106 -cm, preferably $\rho\leqq1\ \Omega$-cm and more preferably $\rho\leqq10^{-1}\ \Omega$-cm), the short circuit current would be limited only by the maximum power (i.e., maximum current capability) of HVPS 101 and/or by any energy stored in its output filter (e.g., filter capacitor) and thereby present a significant shock hazard to a user, produce an unpleasant "snapping" or "popping" sound caused by sparking and/or generate electromagnetic disturbances (e.g., radio frequency interference or rfi). In general, the specific resistance characteristics and geometry (length versus width ratio) of high resistivity portion 103 is selected to provide trouble-free operation while not imposing current limits on EFA operation. This is achieved by providing a comparatively large ratio (preferably if at least ten) between (i) the total length of the accelerating electrode (size transverse to the main fluid flow direction) and (ii) accelerating electrode to its width (size along with fluid flow direction). Generally the length of an electrode should be greater than a width of that electrode. Optimal results may be achieved by providing multiple accelerating electrodes and preferably a number of accelerating electrodes equal to within plus or minus one of the number of corona electrodes, depending on the location and configuration of the electrodes. Note that while FIG. 1 shows two accelerating electrodes and three corona electrodes for purposes of illustration, other electrode configurations might well include three of four accelerating electrodes facing the same three corona electrodes, or comprise other numbers and configurations of alternative electrode configurations.

It should also be considered that localized excessive current may lead to deterioration of the high resistivity material. This is particularly true should a foreign body become lodged between electrodes for some extended period of time (e.g., more than a few milliseconds prior to being cleared). To prevent electrode damage and related failures due to an overcurrent condition, the HVPS may be equipped with a current sensor or other device capable of detecting such an overcurrent event and promptly interrupting power generation or otherwise inhibiting current flow. After a predetermined reset or rest period of time $T_{off}$, power generation may be restored for some minimum predetermined time period $T_{on}$ sufficient for detection of any remaining or residual short circuit condition. If the short circuit condition persists, the HVPS may be shut down or otherwise disabled, again for at least the time period $T_{off}$. Thus, if the overcurrent problem persists, in order to ensure safe operation of the EFA and longevity of the electrodes, HVPS 101 may continue this on-off cycling operation for some number of cycles with $T_{off}$ substantially greater (e.g., ten times or longer) than $T_{on}$. Note that, in certain cases, the cycling will have the effect of clearing certain shorting conditions without requiring manual intervention.

Figure 2:
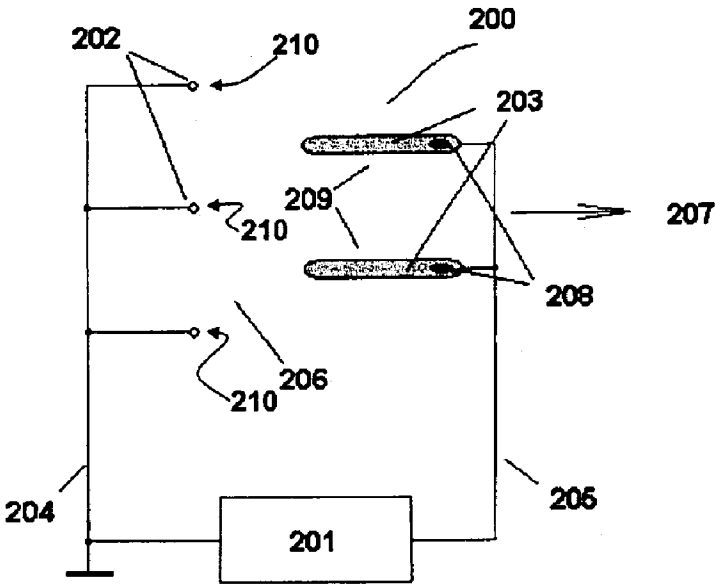
FIG. 2 is a schematic diagram of an EFA assembly with corona electrodes formed as wires and accelerating electrodes formed as high resistance bars, the latter with conductive portions entirely encapsulated within an outer shell.

FIG. 2 depicts another embodiment of an EFA with accelerating electrodes having high resistivity portions. The primary distinction between EFA 100 shown in the FIG. 1 and EFA 200 is that, in the latter, low resistivity portions 208 are completely contained within high resistivity portions 203 of accelerating electrodes 209 (i.e., are fully encapsulated by the surrounding high resistivity material). This modification provides at least two advantages to this embodiment of the invention. First, fully encapsulating low resistivity portions 208 within high resistivity portion 203 enhances safety of the EFA by preventing unintentional or accidental direct contact with the high voltage "hot" terminals of HVPS 201. Secondly, the configuration forces the corona current to flow through a greater portion or volume of high resistivity portion 203 instead of merely a surface region. While surface conductivity for most high resistivity materials (e.g., plastic or rubber) is of the same order as volume (i.e., internal) conductivity, it may dramatically differ (e.g., change over time possibly increasing by several orders of magnitude) due to progressive surface contamination and degradation.

The EFA has an inherent ability to collect particles present in a fluid at the surface of the accelerating electrodes. When some amount or quantity of particles is collected or otherwise accumulate on the accelerating electrodes, the particles may cover the surface of the electrode with a contiguous solid layer of contaminants, e.g., a continuous film. The electrical conductivity of this layer of contaminants may be higher that of the conductivity of the high resistivity material itself. In such a case, the corona current may flow through this contaminant layer and compromise the advantages provided by the high resistivity material. EFA 200 of FIG. 2 avoids this problem by fully encapsulating low resistivity portion 208 within high resistivity portion 203. Note that low resistivity portion 208 need not be continuous or have any point in direct contact with the supply terminals of HVPS 201 or conductive wire 205 providing power from HVPS 201. Is should be appreciated that a primary function of these conductive parts is to counterpoise the electric potential along the length of the accelerating electrodes 209, i.e., distribute the current so that high resistivity portion 203 in contact with low resistivity portion 208 are maintained at some equipotential. If in addition, corona electrodes 202 (including ionizing edges 210) are grounded, there is a substantially reduced or nonexistent opportunity for inadvertent or accidental exposure to dangerous current levels that may result in injury and/or electrocution by high operating voltages, this because there is no "hot" potential to touch throughout the structure.

Figure 3:
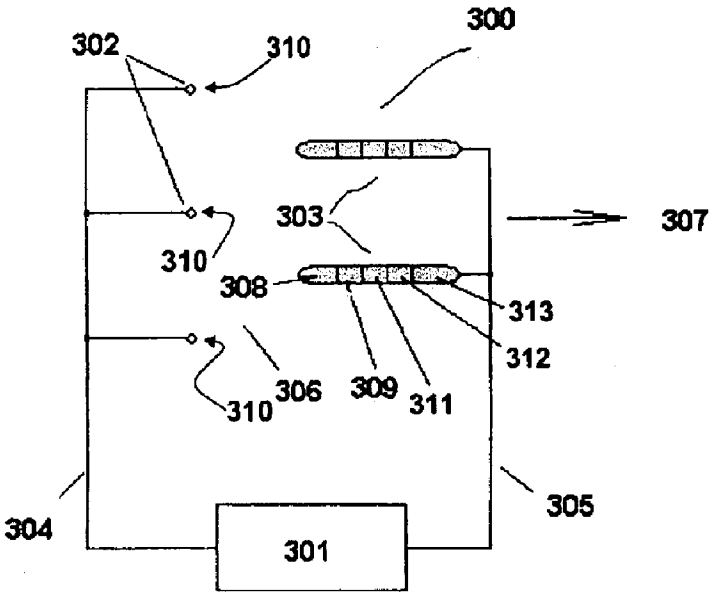
FIG. 3 is a schematic diagram of an EFA assembly with corona electrodes formed as wires and accelerating electrodes formed as high resistance bars with adjacent segments of varying or stepped conductivity along a width of the accelerating electrode.

FIG. 3 is a schematic diagram of an EFA assembly 300 with corona electrodes 302 (preferably formed as longitudinally oriented wires having ionizing edges 310) and accelerating electrodes 303 consisting of a plurality of horizontally stacked high resistivity bars each with a different resistivity value decreasing along the width of the accelerating electrode. Accelerating electrodes 303 are made of several segments 308 through 312 each in intimate contact with its immediately adjacent neighbor(s). Each of these segments is made of a material or otherwise engineered to have a different specific resistivity value $\rho_n$. It has been determined that when the specific resistivity gradually decreases in a direction toward the HVPS 301 terminal connection (i.e., degressively from segment 308 to 309, 311 and 312) the resultant electric field is more uniform in terms of linearity with respect to the main direction of fluid flow. Note that in FIGS. 1 and 2 the electric field lines depicted between corona electrodes 102/202 and acceleration electrodes 103/203 are not perfectly parallel to the main direction of fluid flow but are curved. This curvature causes ions and other charged particles to be accelerated over a range of directions thereby decreasing EFA efficiency. By having a progression of accelerating electrode resistivity values it has been found that ion trajectory is brought into alignment with the main direction of fluid flow particularly as the corona current reaches some maximum value. Also note that while accelerator electrodes 303 are depicted for purposes of illustration as comprising a number of discrete segments of respective resistivity values $\rho_n$, resistivity values may be made to continuously vary over the width of the electrode. Gradual resistivity variation over the width may be achieved by a number of processes including, for example, ion implantation of suitable impurity materials at appropriately varying concentration levels to achieve a gradual increase or decrease in resistivity.

Figure 4:
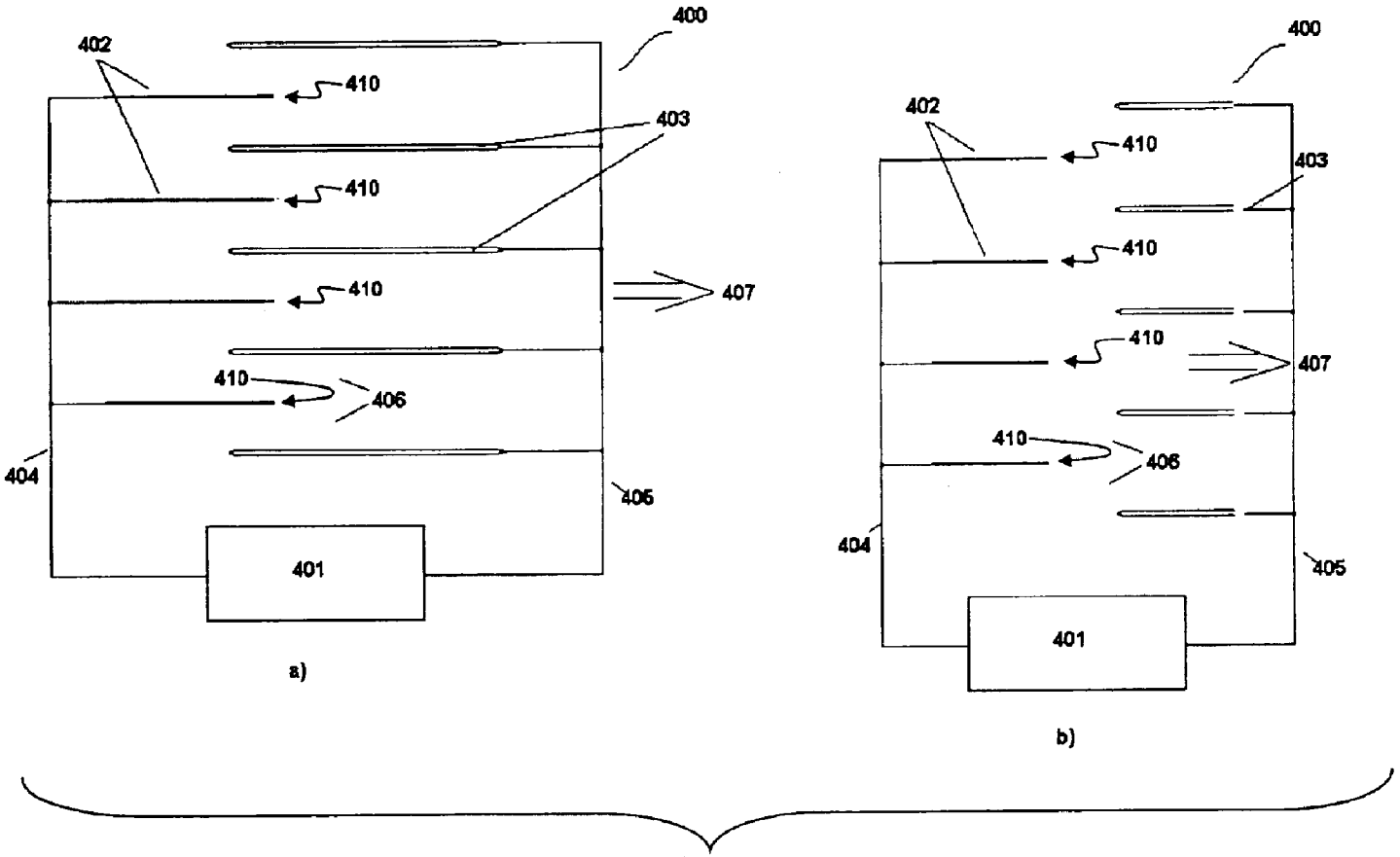
FIG. 4 is a schematic diagram of EFA assembly with corona electrodes in the shape of thin strips located between electrically opposing high resistance accelerating electrodes.

FIGS. 4A and 4B are schematic diagrams of still another embodiment of an EFA 400 in which accelerating electrodes 403 are made of a high resistivity material. While, for illustrative purposes, FIGS. 4A and 4B depict a particular number of corona electrodes 402 and accelerating electrodes 403, respectively, other numbers and configurations may be employed consistent with various embodiments of the invention.

Accelerating electrodes 403 are made of thin strips or layers of one or more high resistivity materials. Corona electrodes 402 are made of a low resistivity material such as metal or a conductive ceramic. HVPS 401 is connected to corona electrodes 402 and accelerating electrodes 403 by conducting wires 404 and 405. The geometry of corona electrodes 402 is in contrast to geometries wherein the electrodes are formed as needles or thin wires which are inherently more difficult to maintain and install and are subject to damage during the course of normal operation of the EFA. A downstream edge of each corona electrode 402 includes an ionizing edge 410. As with other small objects, the thin wire typically used for corona electrodes is fragile and therefore not reliable. Instead, the present embodiment depicted in FIGS. 4A and 4B provides corona electrodes in the shape of relatively wide metallic strips. While these metal strips are necessarily thin at a corona discharge end so as to readily generate a corona discharge along a "downwind" edge thereof, the strips are relatively wide (in a direction along the airflow direction) and thereby less fragile than a correspondingly thin wire.

Another advantage of EFA 400 as depicted in FIG. 4A includes accelerating electrodes 403 that are substantially thinner than those used in prior systems. That is, prior accelerating electrodes are typically much thicker than the associated corona electrodes to avoid generation of an electric field around and about the edges of the accelerating electrodes. The configuration shown in FIG. 4A minimizes or eliminates any electric field generation by accelerating electrodes 403 by placement of the edges of corona electrodes 402 (in the present illustration, the right "downwind" edges of the corona electrodes) counter or opposite to the flat surfaces of the accelerating electrodes 403. That is, at least a portion of the main body of corona electrodes 402 extends downwind in a direction of desired fluid flow past a leading edge of accelerating electrodes 403 whereby an operative portion of corona electrodes 402 along a trailing edge thereof generates a corona discharge between and proximate the extended flat surfaces of accelerating electrodes 403. This orientation and configuration provides an electric field strength in the vicinity of such flat surfaces that is substantially lower than the corresponding electric field strength formed about the trailing edge of corona electrodes 402. Thus, a corona discharge is produced in the vicinity of the trailing edge of corona electrodes 402 and not at the surface of accelerating electrodes 403.

Immediately upon initiation of a corona discharge, a corona current flows through the fluid to be accelerated (e.g., air, insulating liquid, etc.) located between corona electrodes 402 and accelerating electrodes 403 by the generation of ions and charged particles within the fluid and transfer of such charges along the body of accelerating electrodes 403 to HVPS 401 via conductive wire 405. Since no current flows in the opposite direction (i.e., from accelerating electrodes 403 through the fluid to corona electrodes 402), no back corona is produced. It has been further found that this configuration results in an electric field (represented by lines 406) that is substantially more linear with respect to a direction of the desired fluid flow (shown by arrow 407) than might otherwise be provided. The enhanced linearity of the electric field is caused by the voltage drop across accelerating electrodes 403 generating equipotential lines of the electric field that are transverse to the primary direction of fluid flow. Since the electric field lines are orthogonal to such equipotential lines, the electric field lines are more parallel to the direction of primary fluid flow.

Another advantage of EFA 400 as shown in the FIG. 4A is provided by isolation of the active portions (i.e., right edges as depicted in the figure) of corona electrodes 402 from each other by the intervening structure of accelerating electrodes 403. Thus, the corona electrodes "do not see" each other and therefore, in contrast to prior systems, corona electrodes 402 may be positioned in close proximity to one another (that is, in the vertical direction as depicted in FIG. 4A). By employing the design features described in connection with FIG. 4A, two major obstacles to achieving substantial and greater fluid flows are avoided. A first of these obstacles is the high air resistance caused by the relatively thick fronted portions of typical accelerating electrodes. The present configuration provides for both corona and accelerating electrodes that have low drag geometries, that is, formed in aerodynamically "friendly" shapes. For example, these geometries provide a coefficient of drag Cd for air that is no greater than 1, preferably less than 0.1 and more preferably less than 0.01. The actual geometry or shape is necessarily dependent on the desired fluid flow and viscosity of the fluid to be accelerated these factors varying between designs.

A second obstacle overcome by the present embodiment of the invention is the resultant low density of electrodes possible due to conventional inter-electrode spacing requirements necessary according to and observed by prior configurations. For example U.S. Pat. No. 4,812,711 incorporated herein by reference in its entirety, depicts four corona electrodes spaced apart from each other by a distance of 50 mm. Not surprisingly, this relatively low density and small number of electrodes can accommodate only very low power levels with a resultant low level of fluid flow. In contrast, the present embodiments accommodate corona to attractor spacing of less than 10 mm and preferably less than 1 mm.

Still another configuration of electrodes is shown in connection with the EFA 400 of FIG. 4B. In this case, corona electrodes 402 are placed a predetermined distance from accelerating electrodes 403 in a direction of the desired fluid flow as shown in arrow 407. Again, the resultant electric field is substantially linear as depicted by the dashed lines emanating from corona electrodes 402 and directed to accelerating electrodes 403. Note however, that with respect to the direction of the desired fluid flow, corona electrode 402 are not placed "in between" accelerating electrodes 403.

An object of various embodiments of the present invention as depicted in FIG. 4A is directed to achieve closer spacing of corona electrodes (i.e., a higher density of electrodes) consistent with current manufacturing technology than otherwise possible or implemented by other EFA devices. That is, extremely thin and short electrodes may be readily manufactured by a single manufacturing process or step consistent with, for example modem micro-electro-mechanical systems (MEMS) and related semiconductor technologies and capabilities. Referring again to FIG. 4A, it can be seen that adjacent corona electrodes 402 may be vertically spaced apart by a distance less than 1 mm or even only several $\mu$m from each other. The resultant increase in electrode density provides enhanced fluid acceleration and flow rates. For instance, U.S. Pat. No. 4,812,711 describes a device capable of producing an air velocity of only 0.5 meters per second (m/sec). If, instead, the electrodes are spaced 1 mm apart, a 50 fold increase in electrode density and enhanced power capabilities may be achieved to provide a corresponding increase in air velocity, i.e., to about 25 m/sec or 5,000 ft/min. Further, several EFA stages may be placed in succession or tandem in a horizontal direction of desired fluid flow, each stage further accelerating the fluid as it passes through the successive stages. Each of the stages are located a predetermined distance from immediately adjacent stages, this distance determined by the maximum voltage applied to the opposing electrodes of each stage. In particular, when corona discharge and accelerating electrodes of a stage are placed closer together, less voltage is required to initiate and maintain a corona discharge. Therefore, entire stages of an EFA may be similarly placed closer to each other in view of the lower operating voltage used within each stage. This relationship results in a stage density in a horizontal direction that is approximately proportional to the electrode density (e.g., in a vertical direction) within a stage. Thus it can be expected that an electrode "vertical" density increase will provide a similar in "horizontal" density such that fluid flow acceleration is inversely proportional to the square of the inter-electrode distances.

The advantages achieved by various embodiments of the invention are attributable at least in part to use of a high resistivity material as part of the accelerating electrodes. The high resistivity material may comprise a relatively high resistance material, such as carbon filled plastic or rubber, silicon, germanium, tin, gallium arsenide, indium phosphide, boron nitride, silicon carbide, cadmium selenide, etc. These materials should have a specific resistivity $\rho$ in the range of $10^1$ to $10^{10}$ '$\Omega$-cm and, more preferably, between $10^4$ to $10^9$ '$\Omega$-cm with a more preferred range between $10^6$ and $10^7$ '$\Omega$-cm. Use of the high resistivity material supports enhanced electrode densities. For example, closely spaced, metal accelerating electrodes exhibit unstable operating characteristics producing a high frequency of sparking events. In contrast, high resistivity electrodes according to embodiments of the present invention produce a more linear electric field, to thereby minimize the occurrence of sparking and the generation of a back corona emanating from sharp edges of the accelerating electrodes. Elimination of the back corona may be understood with reference to FIG. 4A.

Referring again to FIG. 4A, it can be shown that corona discharge events take place at or along the trailing or right edges of corona electrodes 402 but not along the leading or left edges of accelerating electrodes 403. This is because of the voltage and electric field distribution produced by the corona discharge process. For example, the left edges of accelerating electrodes 403 are at least somewhat thicker than are the right edges of corona electrodes 402, which are either thin or sharpened. Because the electric field near an electrode is approximately proportional to a thickness of the electrode, the corona discharge starts at the trailing edge of corona electrodes 402. The resultant corona current then flows from the trailing edges of corona electrodes 402 to the high voltage terminal of HVPS 401 through two paths. A first path is through ionized portions of the fluid along the electric field depicted by lines 406. A second path is through the body of accelerating electrodes 403. The corona current, flowing through the body of accelerating electrodes 403, results in a voltage drop along this body. This voltage drop progresses from the high voltage terminal as applied to the right edge of accelerating electrodes 403 toward the left edge of the electrode. As the corona current increases, a corresponding increase is exhibited in this voltage drop. When the output voltage of HVPS 401 reaches a level sufficient to initiate corona discharge along the left edge of accelerating electrodes 403, the voltage drop at these edges is sufficiently high to dampen any voltage increase and prevent a corona discharge along the edge of the accelerating electrodes.

Other embodiments of the invention may decrease inter-electrode spacing to the order of, for example, several microns. At such spacing, a corona discharge condition may be initiated by relatively low voltages, the corona discharge being caused, not by the voltage itself, but by the high-intensity electric field generated by the voltage. This electric field strength is approximately proportional to the voltage applied and inversely proportional to the distance between the opposing electrodes. For example, a voltage of about 8 kV is sufficient to initiate a corona discharge with an inter-electrode spacing of approximately 1 cm. Decreasing the inter-electrode spacing by a factor of ten to 1 mm reduces the voltage required for corona discharge initiation to approximately 800V. Further reduction of inter-electrode spacing to 0.1 mm reduces the required corona initiation voltage to 80V, while 10 micron spacing requires only 8V to initiate a corona discharge. These lower voltages provide for closer inter-electrode spacing and spacing between each stage, thereby increasing total fluid acceleration several fold. As previously described, the increase is approximately inversely proportional to the square of the distance between the electrodes resulting in an overall increases of 100, 10,000 and 1,000,000 in air flow, respectively compared to a 1 cm spacing.

Figure 5:
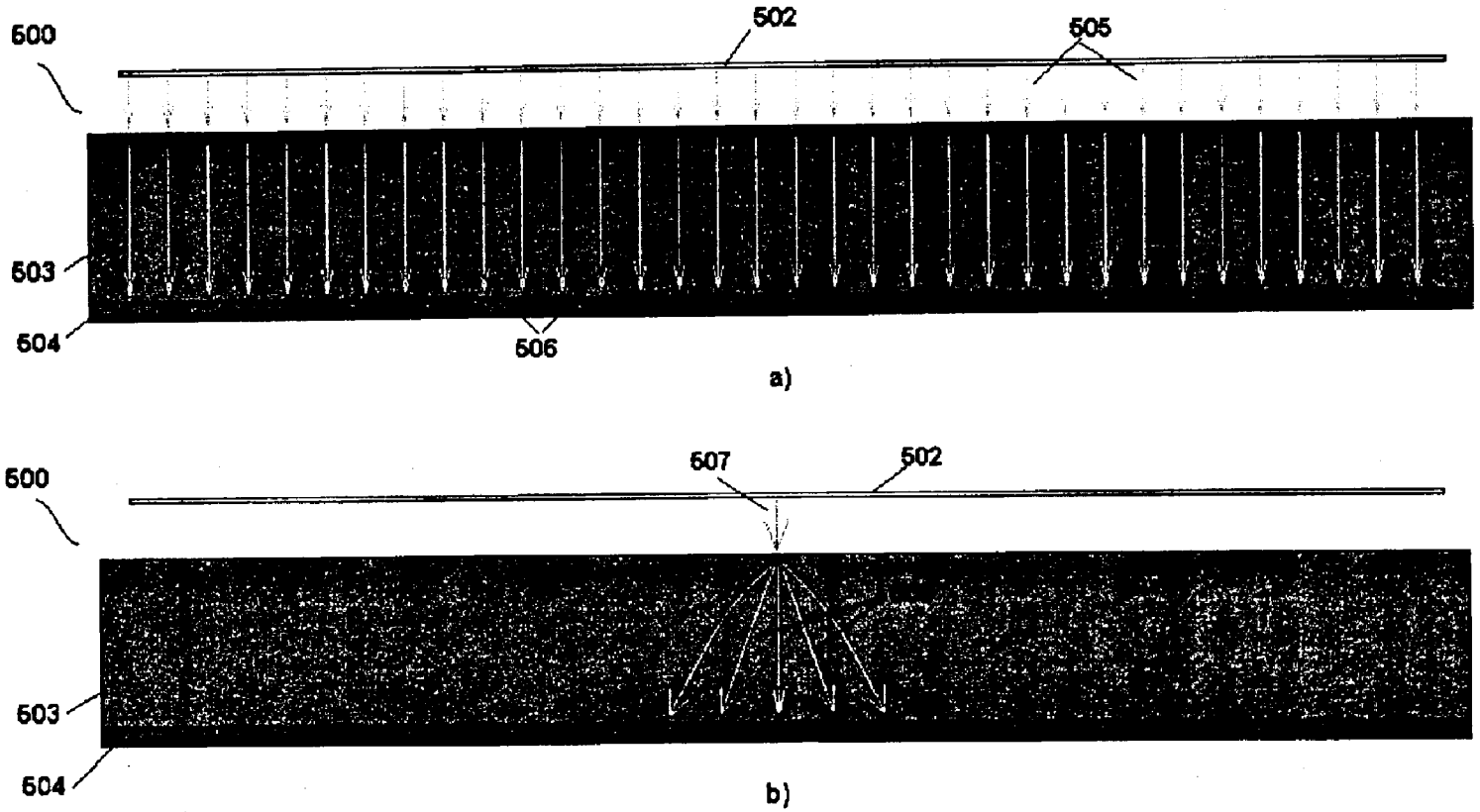
FIG. 5A is a diagram depicting a corona current distribution in a fluid and within a body of a corresponding accelerating electrode.
FIG. 5B is a diagram depicting a path of an electrical current produced as the result of a spark or arc event.

A further explanation of the benefits of use of a high resistivity electrode structure is explained with reference to FIGS. 5A and 5B. Referring to FIG. 5A, EFA 500 includes corona electrode 502 and accelerating electrode 503. Accelerating electrode 503 in turn, includes a low resistivity portion 504 and a high resistivity portion 506. A corona current flows through an ionized fluid present between corona electrode 502 and accelerating electrode 503 (i.e., through the inter-electrode space) over a current path indicated by arrows 505, the path continuing through high resistivity portion 506 of accelerating electrode 503 as indicated by the arrows. Upon the occurrence of a local disturbance, for example a spark event, a resultant discharge current is directed through a narrow path depicted by arrow 507 of FIG. 5B. The current then proceeds along a wider path 508 across high resistivity portion 506. Because the increase current flow emanates from a small region of acceleration electrode 503, only gradually expanding outwardly over path 508, the resulting resistance over path 508 is substantially higher than when such current is distributed over the entirety of high resistivity portion 506. Thus, the spark or a pre-spark event signaled by an increased current flow is limited by the resistance along path 508 thereby limiting the current. If high resistivity portion 506 is selected to have a specific resistance and width to length ratio, any significant current increase can be avoided or mitigated. Such current increases may be caused by a number of events including the aforementioned electrical discharge or spark, presence of a foreign object (e.g., dust, insect, etc.) on or between the electrodes, screwdriver, or even a finger placed between and coming into contact with the electrodes.

Figure 6:
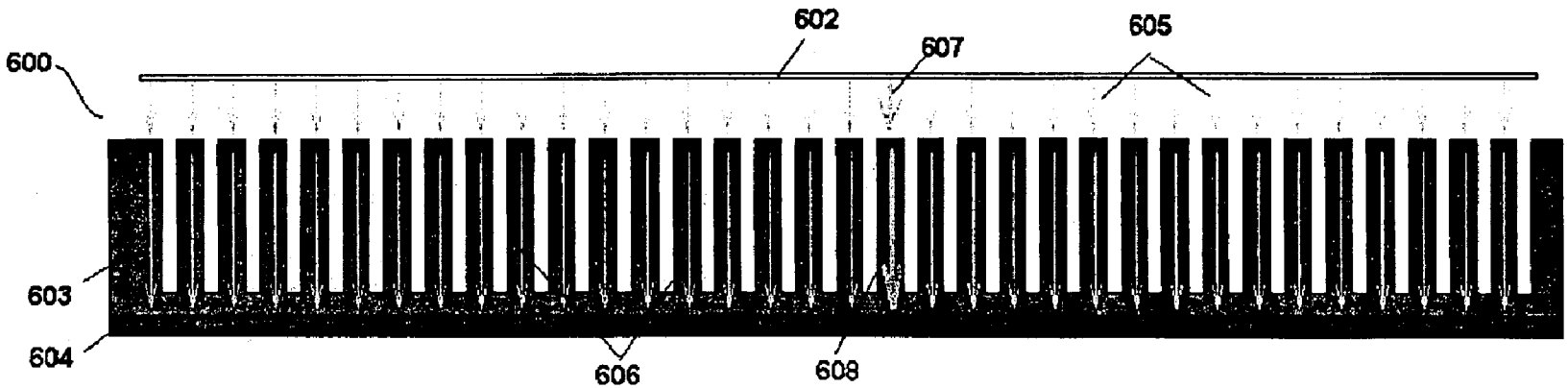
FIG. 6 is a schematic view of a comb-shaped accelerating electrode.

Another embodiment of the invention is shown in FIG. 6. As shown, EFA 600 includes a comb-like high resistivity portion 606 of accelerating electrode 603. Any localized event such as a spark clearly is restricted to flow over a small portion of attracting electrode 603 such as over a single or a small number of teeth near the event. A corona current associated with a normal operating condition is shown by arrows 605. For example, an event such as a spark shown at arrows 607 and 608 is limited to flowing along finger or tooth 606. The resistance over this path is sufficiently high to moderate any increase in current caused by the event. Note that performance is enhanced with increasing number of teeth rather than a selection of a width to length ratio. A typical width to length ratio of 1 to 0.1 may be appropriate with a more preferred ratio of 0.05 to 1 or less.

Figure 7:
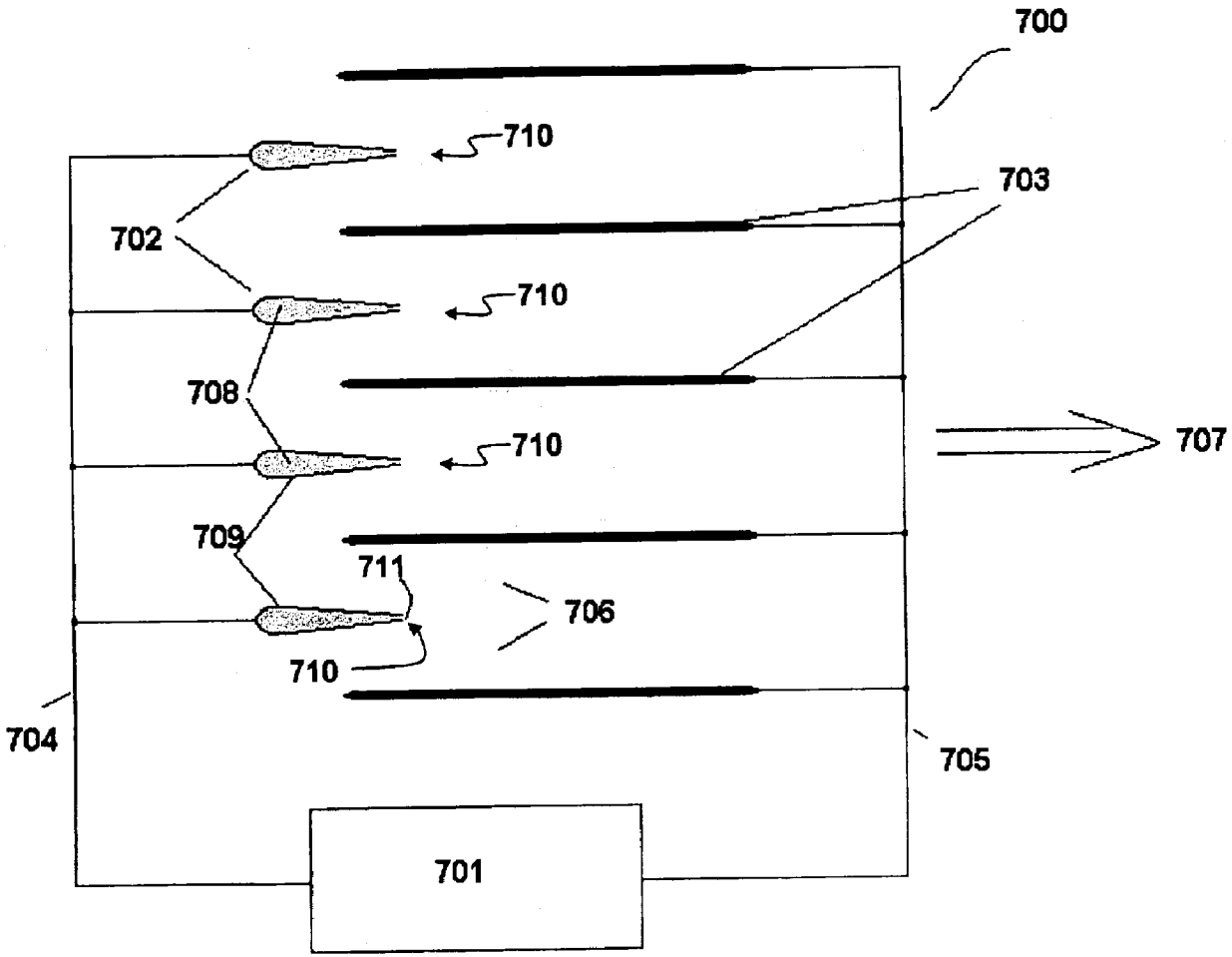
FIG. 7 is a schematic view of hollow, drop-like corona electrodes filled with a conductive fluid and inserted between high resistance accelerating electrodes.

As described, embodiments of the present invention make it possible to use materials other than solids for producing a corona discharge or emission of ions. Generally, solid materials only "reluctantly" give up and produce ions thereby limiting EFA acceleration of a fluid. At the same time, many fluids, such as water, may release more ions if positioned and shaped to produce a corona discharge. For example, use of a conductive fluid as a corona emitting material is described in U.S. Pat. No. 3,751,715. Therein, a teardrop shaped container is described as a trough for containing a conductive fluid. The conductive fluid may be, for example, tap water or more preferably, an aqueous solution including a strong electrolyte such as NaCl, $HNO_3$, NaOH, etc. FIG. 7 shows the operation of an EFA according to an embodiment of the present invention in which EFA 700 includes five accelerating electrodes 703 and four corona electrodes 702. All of these electrodes are shown in cross section. The corona electrodes each consist of narrow elongate non-conductive shells 709 made of an insulating material such as plastic or silicon with slots 711 formed at ionizing edge 710 in the trailing edge or right sides of the shells. The shells 709 of corona electrodes 702 are connected to a conductive fluid supply or reservoir, not shown, via an appropriate supply tube. Slots 711 formed in the trailing edge of corona electrodes 702 are sufficiently narrow so that fluid is contained within shells 709 by fluid molecular tension. Slots 711 may be equipped with sponge-like "stoppages" or nozzle portions to provide a constant, slow release of conductive fluid through the slot. HVPS 701 generates a voltage sufficient to produce a corona discharge such that conductive fluid 708 acts as a sharp-edged conductor and emits ions from the trailing edge of corona electrode 702 at slots 711. Resultant ions of conductive fluid 708 migrate from slot 711 toward accelerating high resistivity electrodes 703 along an electric field represented by lines 706. As fluid is consumed in production of the corona discharge, the fluid is replenished via shells 709 from an appropriate fluid supply or reservoir (not shown).

It should be noted and understood that all publications, patents and patent applications mentioned in this specification are indicative of the level of skill in the art to which the invention pertains. All publications, patents and patent applications are herein incorporated by reference to the same extent as if each individual publication, patent or patent application was specifically and individually indicated to be incorporated by reference in its entirety.

What is claimed is:

1. An electrostatic fluid accelerator comprising:

a first number of corona electrodes having respective ionizing edges;

a second number of accelerating electrodes spaced apart from and having respective edges that are substantially parallel to adjacent ones of said ionizing edges of said corona electrodes, said accelerating electrodes comprising thin fins having a coefficient of drag Cd no greater than 1; and an electrical power source connected to supply said corona and accelerating electrodes with an operating voltage to produce a high intensity electric field in an inter-electrode space between said corona electrodes and said accelerating electrodes, said accelerating electrodes made of a high electrical resistivity material, each of said accelerating electrodes having mutually perpendicular length and height dimension oriented transverse to a desired fluid flow direction and a width dimension oriented parallel to said desired fluid flow direction, a length of said accelerating electrodes in a direction transverse to a desired fluid flow direction being greater than a width of said accelerating electrodes parallel to said fluid flow direction and said width of said accelerating electrodes being at least ten times a height of said accelerating electrodes in a direction transverse to both said desired fluid flow direction and to said length.

2. The electrostatic fluid accelerator according to claim 1 wherein said first and second numbers are each greater than one and said first and second numbers are no more than one different from each other.

3. The electrostatic fluid accelerator according to claim 1 wherein a voltage drop Vd across said accelerating electrodes is no greater than 50% of said operating voltage supplied by said power source.

4. The electrostatic fluid accelerator according to claim 1 wherein a voltage drop Vd across said accelerating electrodes is no greater than 10% of said operating voltage supplied by said power source.

5. The electrostatic fluid accelerator according to claim 1 wherein each of said accelerating electrodes comprise a plurality of segments, each of said segments of one of said accelerating electrodes having a different electrical resistivity than others of said segments of said one accelerating electrode, each of said segments oriented substantially parallel to said ionizing edges of the corona electrodes.

6. An electrostatic fluid accelerator comprising:

a first number of corona electrodes having respective ionizing edges;

a second number of accelerating electrodes spaced apart from and having respective edges that are substantially parallel to adjacent ones of said ionizing edges of said corona electrodes; and an electrical power source connected to supply said corona and accelerating electrodes with an operating voltage to produce a high intensity electric field in an inter-electrode space between said corona electrodes and said accelerating electrodes, said accelerating electrodes made of a high electrical resistivity material, each of said accelerating electrodes having mutually perpendicular length and height dimension oriented transverse to a desired fluid flow direction and a width dimension oriented parallel to said desired fluid flow direction, a length of said accelerating electrodes in a direction transverse to a desired fluid flow direction being greater than a width of said accelerating electrodes parallel to said fluid flow direction and said width of said accelerating electrodes being at least ten times a height of said accelerating electrodes in a direction transverse to both said desired fluid flow direction and to said length, wherein each of said accelerating electrodes comprise a plurality of segments, each of said segments of one of said accelerating electrodes having a different electrical resistivity than others of said segments of said one accelerating electrode, each of said segments oriented substantially parallel to said ionizing edges of the corona electrodes and a resistivity of respective ones of said segments of said accelerating electrodes increases with distance from a nearest one of said corona electrodes.

7. An electrostatic fluid accelerator comprising:

a first number of corona electrodes having respective ionizing edges;

a second number of accelerating electrodes spaced apart from and having respective edges that are substantially parallel to adjacent ones of said ionizing edges of said corona electrodes; and an electrical power source connected to supply said corona and accelerating electrodes with an operating voltage to produce a high intensity electric field in an inter-electrode space between said corona electrodes and said accelerating electrodes, said accelerating electrodes made of a high electrical resistivity material, each of said accelerating electrodes having mutually perpendicular length and height dimension oriented transverse to a desired fluid flow direction and a width dimension oriented parallel to said desired fluid flow direction, a length of said accelerating electrodes in a direction transverse to a desired fluid flow direction being greater than a width of said accelerating electrodes parallel to said fluid flow direction and said width of said accelerating electrodes being at least ten times a height of said accelerating electrodes in a direction transverse to both said desired fluid flow direction and to said length, wherein each of said accelerating electrodes comprise a plurality of segments, each of said segments of one of said accelerating electrodes having a different electrical resistivity than others of said segments of said one accelerating electrode, each of said segments oriented substantially parallel to said ionizing edges of the corona electrodes and a resistivity of respective ones of said segments of said accelerating electrodes decreases with distance from a nearest one of said corona electrodes.

8. The electrostatic fluid accelerator according to claim 7 wherein one of said segments furthest from said nearest corona electrodes having a lowest resistivity has an electrical contact connected to an output terminal of said power source.

9. The electrostatic fluid accelerator according to claim 7 wherein one of said segments furthest from said nearest corona electrodes having a lowest resistivity is not directly connected to an output terminal of said power source.

10. The electrostatic fluid accelerator according to claim 5 wherein portions of adjacent ones of said segments of said accelerating electrodes are spaced apart and are not in intimate contact with each other.

11. The electrostatic fluid accelerator according to claim 5 wherein said accelerating electrodes each comprise an outer portion and an inner portion that is at least partially encapsulated within said outer portion.

12. The electrostatic fluid accelerator according to claim 6 wherein said accelerating electrodes comprise thin fins having a coefficient of drag Cd no greater than 1.

13. The electrostatic fluid accelerator according to claim 1 wherein said coefficient of drag Cd is less than 0.10.

14. The electrostatic fluid accelerator according to claim 1 wherein said accelerating electrodes have a comb-like structure with teeth directed toward the corona electrodes and with a base portion positioned away from the corona electrode.

15. The electrostatic fluid accelerator according to claim 1 wherein said corona electrodes are operational at a ground potential.

16. An electrostatic fluid accelerator comprising:

a number of corona electrodes, each comprising a thin plate-like shape elongated in a direction of a desired fluid flow;

a number of accelerating electrodes spaced apart from the corona electrodes, each of said accelerating electrodes comprising (i) a thin plate-like shape elongated in the direction of the desired fluid flow and (ii) thin fins having a coefficient of drag Cd of no greater than 1, each of said accelerating electrodes substantially parallel to a perspective closest one of said corona electrodes, said corona electrodes positioned between adjacent ones of the accelerating electrodes;

a power source connected to said corona and accelerating electrodes to produce an electric field in an inter-electrode space so as to accelerate a fluid in said inter-electrode space in said direction of said desired fluid flow.

17. The electrostatic fluid accelerator according to claim 16 wherein said corona electrodes each comprise a container for an electrically conductive fluid; and a fluid supply connected to each of said containers for replenishing said electrically conductive fluid.

18. An electrostatic fluid accelerator comprising:

a number of corona electrodes, each comprising a thin plate-like shape elongated in a direction of a desired fluid flow;

a number of accelerating electrodes spaced apart from the corona electrodes, each of said accelerating electrodes comprising a thin plate-like share elongated in the direction of the desired fluid flow, each of said accelerating electrodes substantially parallel to a perspective closest one of said corona electrodes, said corona electrodes positioned between adjacent ones of the accelerating electrodes, said accelerating electrodes comprising a high resistivity material having a specific resistivity ρ of at least $10^{-3}$ ohms-cm;

a power source connected to said corona and accelerating electrodes to produce an electric field in an inter-electrode space so as to accelerate a fluid in said inter-electrode space in said direction of said desired fluid flow.

19. The electrostatic accelerator according to claim 18 wherein said accelerating electrodes comprise a high resistivity material having a specific resistivity ρ of at least $10^{-3}$ ohms-cm.

20. The electrostatic fluid accelerator according to claim 16 wherein said number of the accelerating electrodes is at least one more than said number of the corona electrodes.

21. The electrostatic fluid accelerator according to claim 16 wherein a voltage drop Vd across said accelerating electrodes is no greater than 50% of an output voltage generated by said power source.

22. The electrostatic fluid accelerator according to claim 16 wherein voltage drop Vd across said accelerating electrodes is no greater than 10% of an output voltage generated by said power source.

23. The electrostatic fluid accelerator according to claim 16 wherein said accelerating electrodes consist of a plurality of segments each with a different resistivity, each segment substantially parallel to said corona electrodes.

24. An electrostatic fluid accelerator comprising:

a number of corona electrodes, each comprising a thin plate-like shape elongated in a direction of a desired fluid flow;

a number of accelerating electrodes spaced apart from the corona electrodes, each of said accelerating electrodes comprising a thin plate-like shape elongated in the direction of the desired fluid flow each of said accelerating electrodes substantially parallel to a perspective closest one of said corona electrodes, said corona electrodes positioned between adjacent ones of the accelerating electrodes;

a power source connected to said corona and accelerating electrodes to produce an electric field in an inter-electrode space so as to accelerate a fluid in said inter-electrode space in said direction of said desired fluid flow, wherein said accelerating electrodes consist of a plurality of segments each with a different resistivity, each segment substantially parallel to said corona electrodes and a resistivity of one of said segments closest to said corona electrodes has a lowest value resistivity of each of said segments increasing in a direction progressing away from said corona electrodes.

25. An electrostatic fluid accelerator comprising:

a number of corona electrodes, each comprising a thin plate-like shape elongated in a direction of a desired fluid flow;

a number of accelerating electrodes spaced apart from the corona electrodes, each of said accelerating electrodes comprising a thin plate-like shape elongated in the direction of the desired fluid flow, each of said accelerating electrodes substantially parallel to a perspective closest one of said corona electrodes, said corona electrodes, positioned between adjacent ones of the accelerating electrodes;

a power source connected to said corona and accelerating electrodes to produce an electric field in an inter-electrode space so as to accelerate a fluid in said inter-electrode space in said direction of said desired fluid flow, wherein said accelerating electrodes consist of a plurality of segments each with a different resistivity, each segment substantially parallel to said corona electrodes and a resistivity of one of said segments closest to said corona electrodes has a highest value, a resistivity of each of said segments decreasing in a direction progressing away from said corona electrodes.

26. The electrostatic fluid accelerator according to claim 25 wherein said segment with the lowest resistivity has an electrical contact connected to an output terminal of said power source.

27. The electrostatic fluid accelerator according to claim 25 wherein said segment with the lowest resistivity is not in direct electrical contact with an output terminal of said power source.

28. The electrostatic fluid accelerator according to claim 23 wherein portions of adjacent ones of said segments of said accelerating electrodes are spaced apart and are not in intimate contact with each other.

29. The electrostatic fluid accelerator according to claim 23 wherein said accelerating electrodes each comprise an outer portion and an inner portion that is at least partially encapsulated within said outer portion.

30. The electrostatic fluid accelerator according to claim 7 wherein said accelerating electrodes comprise thin fins having a coefficient of drag Cd of no greater than 1.

31. The electrostatic fluid accelerator according to claim 16 wherein said accelerating electrodes have a comb-like structure with teeth directed toward the corona electrodes and with a base portion positioned away from the corona electrode.

32. The electrostatic fluid accelerator according to claim 16 wherein said corona electrodes are operational at a ground potential.

33. The electrostatic fluid accelerator according to claim 1 wherein said corona electrodes each comprise a container for an electrically conductive fluid; and a fluid supply connected to each of said containers for replenishing said electrically conductive fluid.

34. The electrostatic fluid accelerator according to claim 1 wherein said accelerating electrodes comprise a high resistivity material having a specific resistivity ρ of at least $10^{-3}$ ohms-cm.

35. The electrostatic fluid accelerator according to claim 6 wherein said first and second numbers are each greater than one and said first and second numbers are no more than one different from each other.

36. The electrostatic fluid accelerator according to claim 6 wherein a voltage drop Vd across said accelerating electrodes is no greater than 50% of said operating voltage supplied by said power source.

37. The electrostatic fluid accelerator according to claim 6 wherein a voltage drop Vd across said accelerating electrodes is no greater than 10% of said operating voltage supplied by said power source.

38. The electrostatic fluid accelerator according to claim 6 wherein portions of adjacent ones of said segments of said accelerating electrodes are spaced apart and are not in intimate contact with each other.

39. The electrostatic fluid accelerator according to claim 6 wherein said accelerating electrodes each comprise an outer portion and an inner portion that is at least partially encapsulated within said outer portion.

40. The electrostatic fluid accelerator according to claim 6 wherein said accelerating electrodes have a comb-like structure with teeth directed toward the corona electrodes and with a base portion positioned away from the corona electrode.

41. The electrostatic fluid accelerator according to claim 6 wherein said corona electrodes are operational at a ground potential.

42. The electrostatic fluid accelerator according to claim 6 wherein said corona electrodes each comprise a container for an electrically conductive fluid; and a fluid supply connected to each of said containers for replenishing said electrically conductive fluid.

43. The electrostatic fluid accelerator according to claim 6 wherein said accelerating electrodes comprise a high resistivity material having a specific resistivity ρ of at least $10^{-3}$ ohms-cm.

44. The electrostatic fluid accelerator according to claim 7 wherein said first and second numbers are each greater than one and said first and second numbers are no more than one different from each other.

45. The electrostatic fluid accelerator according to claim 7 wherein a voltage drop Vd across said accelerating electrodes is no greater than 50% of said operating voltage supplied by said power source.

46. The electrostatic fluid accelerator according to claim 7 wherein a voltage drop Vd across said accelerating electrodes is no greater than 10% of said operating voltage supplied by said power source.

47. The electrostatic fluid accelerator according to claim 7 wherein portions of adjacent ones of said segments of said accelerating electrodes are spaced apart and are not in intimate contact with each other.

48. The electrostatic fluid accelerator according to claim 7 wherein said accelerating electrodes each comprise an outer portion and an inner portion that is at least partially encapsulated within said outer portion.

49. The electrostatic fluid accelerator according to claim 7 wherein said accelerating electrodes have a comb-like structure with teeth directed toward the corona electrodes and with a base portion positioned away from the corona electrode.

50. The electrostatic fluid accelerator according to claim 7 wherein said corona electrodes are operational at a ground potential.

51. The electrostatic fluid accelerator according to claim 7 wherein said corona electrodes each comprise a container for an electrically conductive fluid; and a fluid supply connected to each of said containers for replenishing said electrically conductive fluid.

52. The electrostatic fluid accelerator according to claim 7 wherein said accelerating electrodes comprise a high resistivity material having a specific resistivity ρ of at least $10^{-3}$ ohms-cm.

53. The electrostatic fluid accelerator according to claim 23 wherein a resistivity of respective ones of said segments of said accelerating electrodes increases with distance from a nearest one of said corona electrodes.

54. The electrostatic fluid accelerator according to claim 23 wherein a resistivity of respective ones of said segments of said accelerating electrodes decreases with distance from a nearest one of said corona electrodes.

55. The electrostatic fluid accelerator according to claim 54 wherein one of said segments furthest from said nearest corona electrodes having a lowest resistivity has an electrical contact connected to an output terminal of said power source.

56. The electrostatic fluid accelerator according to claim 54 wherein one of said segments furthest from said nearest corona electrodes having a lowest resistivity is not directly connected to an output terminal of said power source.

57. The electrostatic fluid accelerator according to claim 16 wherein said coefficient of drag Cd is less than 0.10.

58. The electrostatic fluid accelerator according to claim 18 wherein said first and second numbers are each greater than one and said first and second numbers are no more than one different from each other.

59. The electrostatic fluid accelerator according to claim 18 wherein a voltage drop Vd across said accelerating electrodes is no greater than 50% of said operating voltage supplied by said power source.

60. The electrostatic fluid accelerator according to claim 18 wherein a voltage drop Vd across said accelerating electrodes is no greater than 10% of said operating voltage supplied by said power source.

61. The electrostatic fluid accelerator according to claim 18 wherein each of said accelerating electrodes comprise a plurality of segments, each of said segments of one of said accelerating electrodes having a different electrical resistivity than others of said segments of said one accelerating electrode, each of said segments oriented substantially parallel to said ionizing edges of the corona electrodes.

62. The electrostatic fluid accelerator according to claim 61 wherein portions of adjacent ones of said segments of said accelerating electrodes are spaced apart and are not in intimate contact with each other.

63. The electrostatic fluid accelerator according to claim 18 wherein said accelerating electrodes each comprise an outer portion and an inner portion that is at least partially encapsulated within said outer portion.

64. The electrostatic fluid accelerator according to claim 18 wherein said accelerating electrodes have a comb-like structure with teeth directed toward the corona electrodes and with a base portion positioned away from the corona electrode.

65. The electrostatic fluid accelerator according to claim 18 wherein said corona electrodes are operational at a ground potential.

66. The electrostatic fluid accelerator according to claim 18 wherein said corona electrodes each comprise a container for an electrically conductive fluid; and a fluid supply connected to each of said containers for replenishing said electrically conductive fluid.

67. The electrostatic fluid accelerator according to claim 24 wherein said first and second numbers are each greater than one and said first and second numbers are no more than one different from each other.

68. The electrostatic fluid accelerator according to claim 24 wherein a voltage drop Vd across said accelerating electrodes is no greater than 50% of said operating voltage supplied by said power source.

69. The electrostatic fluid accelerator according to claim 24 wherein a voltage drop Vd across said accelerating electrodes is no greater than 10% of said operating voltage supplied by said power source.

70. The electrostatic fluid accelerator according to claim 24 wherein portions of adjacent ones of said segments of said accelerating electrodes are spaced apart and are not in intimate contact with each other.

71. The electrostatic fluid accelerator according to claim 24 wherein said accelerating electrodes each comprise an outer portion and an inner portion that is at least partially encapsulated within said outer portion.

72. The electrostatic fluid accelerator according to claim 24 wherein said accelerating electrodes have a comb-like structure with teeth directed toward the corona electrodes and with a base portion positioned away from the corona electrode.

73. The electrostatic fluid accelerator according to claim 24 wherein said corona electrodes are operational at a ground potential.

74. The electrostatic fluid accelerator according to claim 24 wherein said corona electrodes each comprise a container for an electrically conductive fluid; and a fluid supply connected to each of said containers for replenishing said electrically conductive fluid.

75. The electrostatic fluid accelerator according to claim 25 wherein said first and second numbers are each greater than one and said first and second numbers are no more than one different from each other.

76. The electrostatic fluid accelerator according to claim 25 wherein a voltage drop Vd across said accelerating electrodes is no greater than 50% of said operating voltage supplied by said power source.

77. The electrostatic fluid accelerator according to claim 25 wherein a voltage drop Vd across said accelerating electrodes is no greater than 10% of said operating voltage supplied by said power source.

78. The electrostatic fluid accelerator according to claim 25 wherein portions of adjacent ones of said segments of said accelerating electrodes are spaced apart and are not in intimate contact with each other.

79. The electrostatic fluid accelerator according to claim 25 wherein said accelerating electrodes each comprise an outer portion and an inner portion that is at least partially encapsulated within said outer portion.

80. The electrostatic fluid accelerator according to claim 25 wherein said accelerating electrodes have a comb-like structure with teeth directed toward the corona electrodes and with a base portion positioned away from the corona electrode.

81. The electrostatic fluid accelerator according to claim 25 wherein said corona electrodes are operational at a ground potential.

82. The electrostatic fluid accelerator according to claim 25 wherein said corona electrodes each comprise a container for an electrically conductive fluid; and a fluid supply connected to each of said containers for replenishing said electrically conductive fluid.

83. An electrostatic fluid accelerator comprising:

a first number of corona electrodes having respective ionizing edges;

a second number of accelerating electrodes spaced apart from and having respective edges that are substantially parallel to adjacent ones of said ionizing edges of said corona electrodes, said accelerating electrodes comprising thin fins; and an electrical power source connected to supply said corona and accelerating electrodes with an operating voltage to produce a high intensity electric field in an inter-electrode space between said corona electrodes and said accelerating electrodes, said accelerating electrodes made of a high electrical resistivity material, each of said accelerating electrodes having mutually perpendicular length and height dimension oriented transverse to a desired fluid flow direction and a width dimension oriented parallel to said desired fluid flow direction, a length of said accelerating electrodes in a direction transverse to a desired fluid flow direction being greater than a width of said accelerating electrodes parallel to said fluid flow direction and said width of said accelerating electrodes being at least ten times a height of said accelerating electrodes in a direction transverse to both said desired fluid flow direction and to said length.

84. An electrostatic fluid accelerator comprising:

a first number of corona electrodes having respective ionizing edges;

a second number of accelerating electrodes spaced apart from and having respective edges that are substantially parallel to adjacent ones of said ionizing edges of said corona electrodes, said accelerating electrodes having a coefficient of drag Cd no greater than 1; and an electrical power source connected to supply said corona and accelerating electrodes with an operating voltage to produce a high intensity electric field in an inter-electrode space between said corona electrodes and said accelerating electrodes, said accelerating electrodes made of a high electrical resistivity material, each of said accelerating electrodes having mutually perpendicular length and height dimension oriented transverse to a desired fluid flow direction and a width dimension oriented parallel to said desired fluid flow direction, a length of said accelerating electrodes in a direction transverse to a desired fluid flow direction being greater than a width of said accelerating electrodes parallel to said fluid flow direction and said width of said accelerating electrodes being at least ten times a height of said accelerating electrodes in a direction transverse to both said desired fluid flow direction and to said length.

85. An electrostatic fluid accelerator:

a first number of corona electrodes having respective ionizing edges;

a second number of accelerating electrodes spaced apart from and having respective edges that are substantially parallel to adjacent ones of said ionizing edges of said corona electrodes; and an electrical power source connected to supply said corona and accelerating electrodes with an operating voltage to produce a high intensity electric field in an inter-electrode space between said corona electrodes and said accelerating electrodes, said accelerating electrodes made of a high electrical resistivity material, each of said accelerating electrodes having mutually perpendicular length and height dimension oriented transverse to a desired fluid flow direction and a width dimension oriented parallel to said desired fluid flow direction, a length of said accelerating electrodes in a direction transverse to a desired fluid flow direction being greater than a width of said accelerating electrodes parallel to said fluid flow direction and said width of said accelerating electrodes being at least ten times a height of said accelerating electrodes in a direction transverse to both said desired fluid flow direction and to said length, a resistivity of said accelerating electrodes increasing with distance from said corona electrodes.

86. An electrostatic fluid accelerator comprising:

a first number of corona electrodes having respective ionizing edges;

a second number of accelerating electrodes spaced apart from and having respective edges that are substantially parallel to adjacent ones of said ionizing edges of said corona electrodes; and an electrical power source connected to supply said corona and accelerating electrodes with an operating voltage to produce a high intensity electric field in an inter-electrode space between said corona electrodes and said accelerating electrodes, said accelerating electrodes made of a high electrical resistivity material, each of said accelerating electrodes having mutually perpendicular length and height dimension oriented transverse to a desired fluid flow direction and a width dimension oriented parallel to said desired fluid flow direction, a length of said accelerating electrodes in a direction transverse to a desired fluid flow direction being greater than a width of said accelerating electrodes parallel to said fluid flow direction and said width of said accelerating electrodes being at least ten times a height of said accelerating electrodes in a direction transverse to both said desired fluid flow direction and to said length, a resistivity of said accelerating electrodes decreasing with distance from said corona electrodes.

* * * * *